US010736395B2

(12) United States Patent
Kodama et al.

(10) Patent No.: US 10,736,395 B2
(45) Date of Patent: Aug. 11, 2020

(54) APPLICATOR-EQUIPPED AEROSOL CONTAINER

(71) Applicant: Kao Corporation, Tokyo (JP)

(72) Inventors: Daisuke Kodama, Loveland, OH (US); Laura Knoll Price, Cincinnati, OH (US)

(73) Assignee: Kao Corporation, Tokyo (JP)

( * ) Notice: Subject to any disclaimer, the term of this patent is extended or adjusted under 35 U.S.C. 154(b) by 325 days.

(21) Appl. No.: 15/532,738

(22) PCT Filed: Dec. 1, 2015

(86) PCT No.: PCT/US2015/063074

§ 371 (c)(1),
(2) Date: Jun. 2, 2017

(87) PCT Pub. No.: WO2016/089803

PCT Pub. Date: Jun. 9, 2016

(65) Prior Publication Data

US 2018/0116365 A1 May 3, 2018

Related U.S. Application Data

(60) Provisional application No. 62/086,389, filed on Dec. 2, 2014.

(51) Int. Cl.
*A45D 24/22* (2006.01)
*A45D 19/02* (2006.01)
(Continued)

(52) U.S. Cl.
CPC ..... *A45D 24/22* (2013.01); *A45D 19/02* (2013.01); *B65D 83/285* (2013.01); *A45D 2200/057* (2013.01); *A46B 11/0017* (2013.01)

(58) Field of Classification Search
CPC ..... A45D 24/22; A45D 19/02; A45D 27/08; A45D 2200/057; A46B 11/0017
(Continued)

(56) References Cited

U.S. PATENT DOCUMENTS 3,961,635 A * 6/1976 Miya ..... A45D 24/26 132/113
4,636,102 A * 1/1987 Drake ..... A46B 11/0017 222/402.13
(Continued)

FOREIGN PATENT DOCUMENTS

EP 2 580 985 A1 4/2013
JP 2004-114017 A 4/2004
(Continued)

OTHER PUBLICATIONS

International Search Report and Written Opinion dated Feb. 12, 2016 for Application No. PCT/US2015/063074, 9 pgs.

*Primary Examiner* — Tatiana L Nobrega
*Assistant Examiner* — Sarah Woodhouse
(74) *Attorney, Agent, or Firm* — Frost Brown Todd LLC

(57) ABSTRACT

An applicator-equipped aerosol container includes an aerosol main body, and an applicator that includes comb-teeth attached to an upper end section of the aerosol main body. Contents of the applicator-equipped aerosol container may be, for example, chemical agents, cleaning agents or hair treating agents. Contents can be ejected from the applicator-equipped aerosol container by pressing down on a stem part of the container such that contents are dispensed from the aerosol main body of the container through the comb-teeth.

15 Claims, 12 Drawing Sheets

(51) Int. Cl.
*A45D 19/00* (2006.01)
*B65D 83/28* (2006.01)
*A46B 11/00* (2006.01)

(58) Field of Classification Search
USPC ..... 132/116, 112; 401/190
See application file for complete search history.

(56) References Cited

U.S. PATENT DOCUMENTS

| | | | | | |
|---|---|---|---|---|---|
| 6,000,405 | A * | 12/1999 | De Laforcade ..... | B65D 83/285 | 132/112 |
| 2013/0174860 | A1* | 7/2013 | Takagi ..... | A45D 24/22 | 132/200 |
| 2013/0284196 | A1* | 10/2013 | Murdock ..... | A45D 19/02 | 132/200 |

FOREIGN PATENT DOCUMENTS

| | | | |
|---|---|---|---|
| JP | 2004-154459 | A | 6/2004 |
| JP | 2005-206211 | A | 8/2005 |
| JP | 2007-312849 | A | 12/2007 |

* cited by examiner

FIG. 6(a)
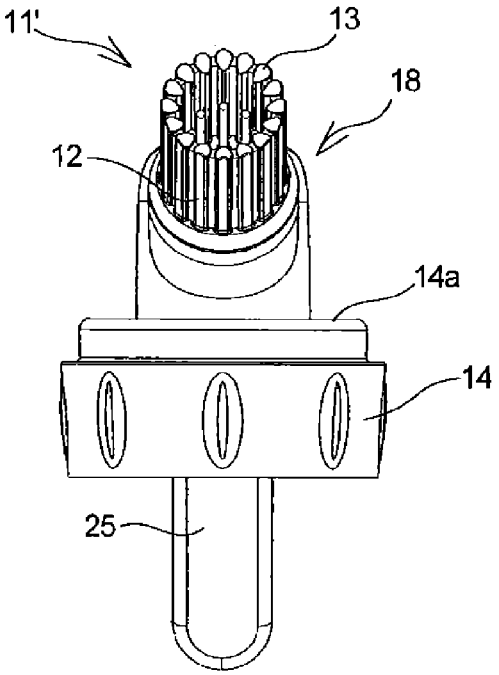
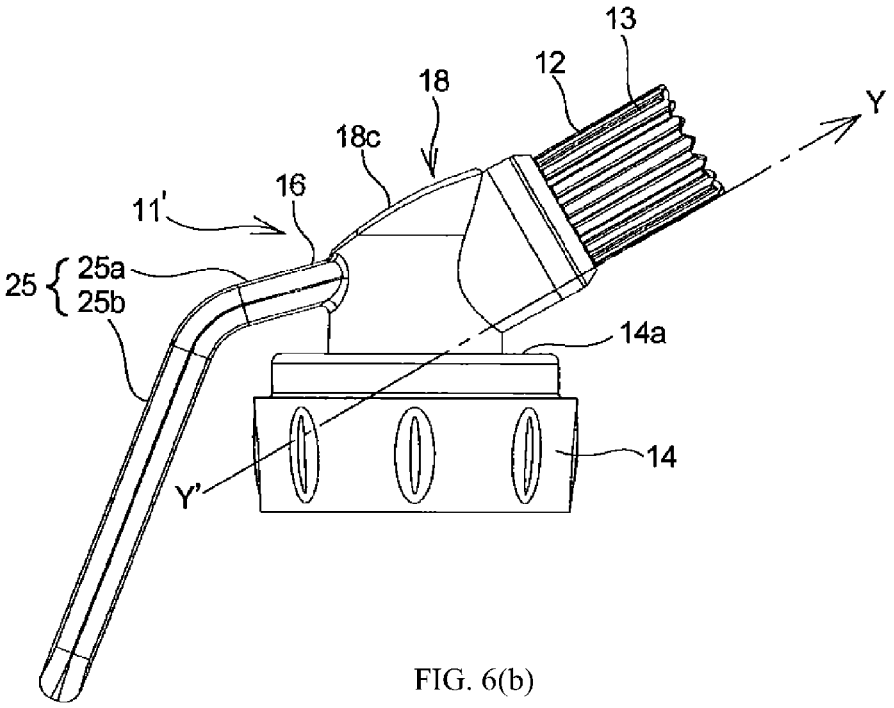
FIG. 6(b)

APPLICATOR-EQUIPPED AEROSOL CONTAINER

TECHNICAL FIELD

The present invention relates to an applicator-equipped aerosol container including: an aerosol main body in which a hair treating agent and a propellant are contained; and an applicator including a comb-teeth part.

BACKGROUND ART

An aerosol container is a product in which contents, e.g. chemical agents, cleaning agents, or hair treating agents, that are sealed inside a container main body together with a propellant are ejected in the form of e.g. atomized or foamed liquid by downwardly pressing a stem part which protrudes in a state where it is biased by a spring in a valve-embedded part of a mounting cap that seals the container main body.

Also, various applicator-equipped aerosol containers have been developed as a hair treating agent-ejecting aerosol container including: an aerosol main body in which a hair treating agent and a propellant are contained; and an applicator that includes a comb-teeth part and that is attached to an upper end section of the aerosol main body via a cap part (see, for example, Patent Literatures 1 and 2).

In these conventional applicator-equipped aerosol containers, a pressing force is applied to a finger-placing part provided to the applicator, and thereby, the stem part is pressed downward by means of the applicator, thus causing a hair treating agent, such as a hair dye agent, to jet out and the jetted hair dye agent etc. to be fed from the aerosol main body toward the comb-teeth part. Further, such aerosol containers are configured so that: the hair dye agent etc. fed from the aerosol main body is ejected from e.g. an ejection opening opened in a comb-teeth base part of the comb-teeth part and preferably to an inner region surrounded by a plurality of comb teeth; and the hair dye agent etc. can be applied to the hair while combing the hair with the comb teeth.

CITATION LIST

Patent Literature

Patent Literature 1: JP 2005-206211 A
Patent Literature 2: JP 2007-312849 A

SUMMARY OF INVENTION

The present invention is an applicator-equipped aerosol container including: an aerosol main body in which a hair treating agent and a propellant are contained; and an applicator that includes a comb-teeth part and that is attached to an upper end section of the aerosol main body via a cap part. The applicator includes: an application flow path having one end thereof in communication with a stem part of the aerosol main body, and the other end thereof opened into the comb-teeth part; and a stem press-down mechanism including a finger-placing part for downwardly pressing the stem part. Comb teeth of the comb-teeth part are provided so as to extend out from a comb-teeth base part, and the direction toward which the comb teeth extend is in one direction which is outward from the cap part and which is inclined with respect to the axial direction of the stein part. The finger-placing part is arranged above an imaginary extension line that is in a direction opposite from the direction toward which the lowermost comb tooth, among the plurality of comb teeth, extends. The comb-teeth part and the finger-placing part are provided in a head part that protrudes upward from a top surface of the cap part. The stem press-down mechanism is formed by arranging the head part in a downwardly-pressable cantilever region that is provided in a cantilevered fashion from a cantilever base-end part which is contiguous to the top surface. The cantilever base-end part is provided on a side, of the cantilever region, in the direction toward which the comb teeth extend. By receiving a press-down force from the finger-placing part, the head part is pressed downward by employing the cantilever base-end part as a support part, and thereby, the head part downwardly presses the stein part which is in communication with the one end of the application flow path, and causes the hair treating agent to be ejected from the aerosol main body to the comb-teeth part via the application flow path.

BRIEF DESCRIPTION OF DRAWINGS

FIG. 4(*b*) is a left side view of an applicator.

FIG. 4(*c*) is a rear view of an applicator.

FIG. 4(*d*) is a top view of an applicator.

FIG. 4(*e*) is a bottom view of an applicator.

FIG. 6(*b*) is a left side view of an applicator of another embodiment.

FIG. 6(*c*) is a rear view of an applicator of another embodiment.

FIG. 6(*d*) is a top view of an applicator of another embodiment.

FIG. 6(*e*) is a bottom view of an applicator of another embodiment.

FIG. 8(*b*) is a left side view of an applicator of yet another embodiment.

FIG. 8(*c*) is a rear view of an applicator of yet another embodiment.

FIG. 8(*d*) is a top view of an applicator of yet another embodiment.

FIG. 8(*e*) is a bottom view of an applicator of yet another embodiment.

DETAILED DESCRIPTION OF INVENTION

Figure 1:
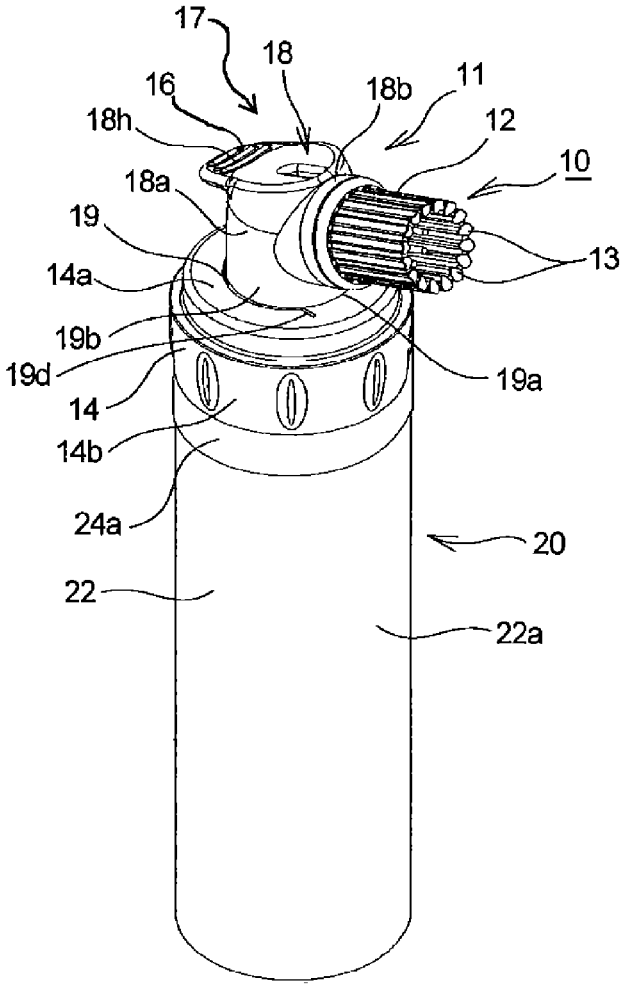
FIG. 1 is a perspective view of an applicator-equipped aerosol container according to a preferred embodiment of the present invention.

In a conventional applicator-equipped aerosol container having an applicator provided with a comb-teeth part, a finger-placing part—which is for downwardly pressing a stem part at the time of ejecting a hair treating agent from an aerosol main body—is arranged in a position, of the applicator, as close as possible to the stem part so that the stem part can be pressed down stably by means of the applicator. On the other hand, the comb-teeth part, which is provided with comb teeth, is arranged at the end of an intervening long-narrow neck part, and is thus arranged in a section, of the applicator, that is separated from the stem part and far from the finger-placing part. Thus, if, for example, a user attempts to apply a hair treating agent while combing the hair with the comb teeth of the comb-teeth part at the same time as gripping the vertically-long tubular body part, of the aerosol main body and pressing the finger-placing part to eject the hair treating agent toward the comb-teeth part, a large moment force will be applied to the comb-teeth part, making it difficult to apply the hair treating agent while combing the hair simultaneously with ejecting the hair treating agent.

Particularly, at the time of applying a hair treating agent spot-by-spot while combing the hair at the same time as ejecting the hair treating agent, such as in cases where the user wishes to efficiently dye a portion of his/her hair by himself/herself only in a predetermined limited region preferably while visually checking the process, it is difficult to stably perform the operation of applying the hair treating agent, while combing the hair at the same time as ejecting the hair treating agent accurately and precisely to hair within such a specific region.

The present invention relates to an applicator-equipped aerosol container with which it is possible to stably and efficiently perform the operation of applying a hair treating agent while combing the hair at the same time as ejecting the hair treating agent accurately and precisely to hair in a predetermined region.

The present invention is an applicator-equipped aerosol container including: an aerosol main body in which a hair treating agent and a propellant are contained; and an applicator that includes a comb-teeth part and that is attached to an upper end section of the aerosol main body via a cap part. The applicator includes: an application flow path having one end thereof in communication with a stem part of the aerosol main body, and the other end thereof opened into the comb-teeth part; and a stem press-down mechanism including a finger-placing part for downwardly pressing the stem part. Comb teeth of the comb-teeth part are provided so as to extend out from a comb-teeth base part and the direction toward which the comb teeth extend is in one direction which is outward from the cap part and which is inclined with respect to the axial direction of the stem part. The finger-placing part is arranged above an imaginary extension line that is in a direction opposite from the direction toward which the lowermost comb tooth, among the plurality of comb teeth, extends. The comb-teeth part and the finger-placing part are provided in a head part that protrudes upward from a top surface of the cap part. The stem press-down mechanism is formed by arranging the head part in a downwardly-pressable cantilever region that is provided in a cantilevered fashion from a cantilever base-end part which is contiguous to the top surface. The cantilever base-end part is provided on a side, of the cantilever region, in the direction toward which the comb teeth extend. By receiving a press-down force from the finger-placing part, the head part is pressed downward by employing the cantilever base-end part as a support part, and thereby, the head part downwardly presses the stem part which is in communication with the one end of the application flow path, and causes the hair treating agent to be ejected from the aerosol main body to the comb-teeth part via the application flow path.

The present invention is described below according to preferred embodiments thereof with reference to the drawings. An applicator-equipped aerosol container 10 according to a preferred embodiment of the present invention as illustrated in FIG. 1 is a container having a compact shape wherein a hair treating agent, such as a hair dye agent, is applied to the hair while ejecting the hair dye agent etc. to a comb-teeth part 12 of an applicator 11 and combing the hair with a plurality of comb teeth 13 of the comb-teeth part 12 in a state where the container is held with the hand. The applicator-equipped aerosol container 10 of the present embodiment has the function of allowing a hair treating agent to be applied efficiently by a stable operation while combing the hair at the same time as ejecting the hair treating agent accurately and precisely to hair in predetermined regions, even in cases where e.g. the user washes to dye his/her hair by himself/herself partially and spot-by-spot in predetermined regions, preferably while visually checking the process.

In a conventional applicator-equipped aerosol container, a finger-placing part for downwardly pressing a stem part of an aerosol main body is arranged in a position, of the applicator, as close as possible to the stem part. On the other hand, the comb-teeth part is arranged in a section that is separated from the stem part and far from the finger-placing part. Thus, at the time of application, a large moment force is applied to the comb-teeth part, and therefore, it is difficult to stably perform, for example, the operation of applying a hair treating agent, while combing the hair with the comb-teeth part at the same time as holding the body part, of the aerosol main body and pressing the finger-placing part to eject the hair treating agent. Thus, with conventional applicator-equipped aerosol containers, if, for example, a user wishes to accurately apply a hair treating agent by himself/herself partially to portions of hair in predetermined regions while visually checking the process, he/she will need to perform a two-stage operation, i.e. first eject a predetermined amount of hair treating agent from the aerosol main body to the comb-teeth part of the applicator by pressing down on the finger-placing part, and then remove his/her finger from the finger-placing part and re-hold the body part; and then apply the hair treating agent to hair in a predetermined region while combing the hair. This makes it difficult to apply the hair treating agent efficiently.

The applicator-equipped aerosol container 10 of the present embodiment has been made in view of the aforementioned technical problems specific to conventional applicator-equipped aerosol containers, and the present aerosol container makes it possible to stably and efficiently perform the operation of applying a hair treating agent, such as a hair dye agent, to the hair while combing the hair at the same time as ejecting the hair treating agent accurately and precisely to a portion of hair in a predetermined region. The applicator-equipped aerosol container 10 of the present embodiment is employed as a form during use.

Figure 2:
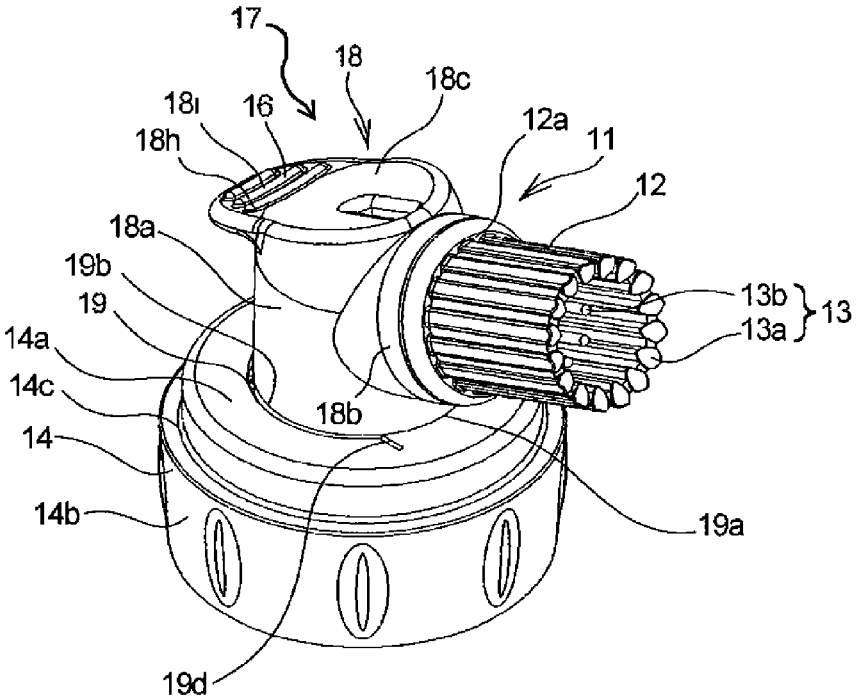
FIG. 2 is a perspective view of an applicator of an applicator-equipped aerosol container according to a preferred embodiment of the present invention.
Figure 3:
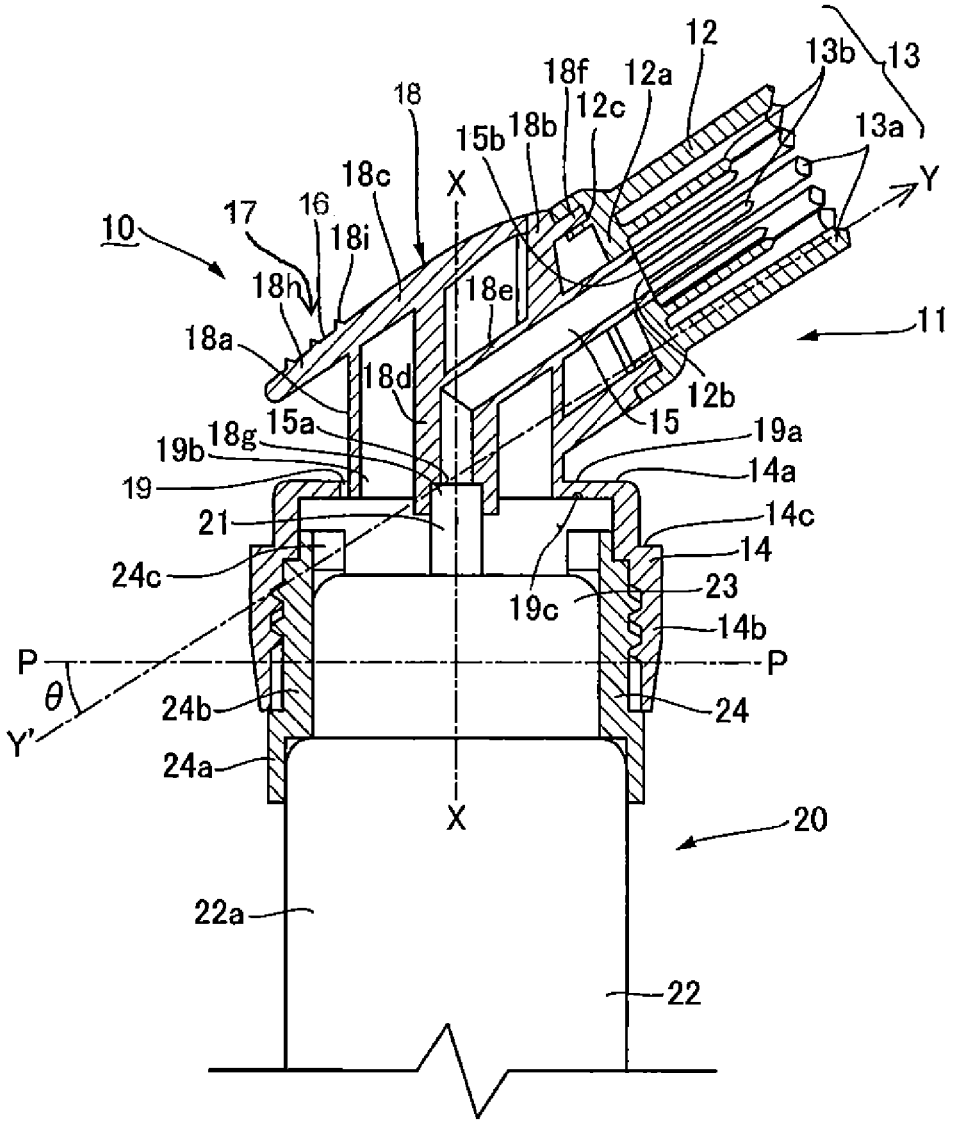
FIG. 3 is a partial cross-sectional view of main parts of an applicator-equipped aerosol container according to a preferred embodiment of the present invention.
Figure 4A:
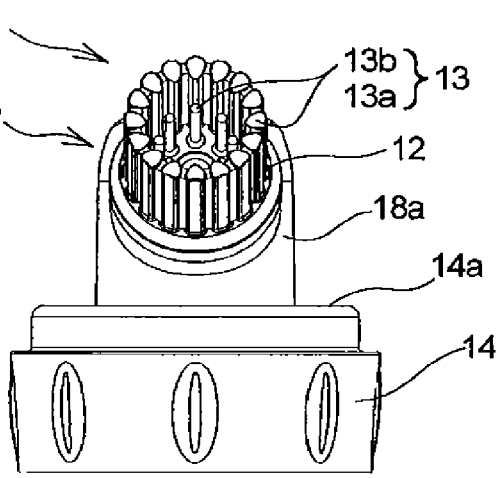
FIG. 4(*a*) is a front view of an applicator.
Figure 4B:
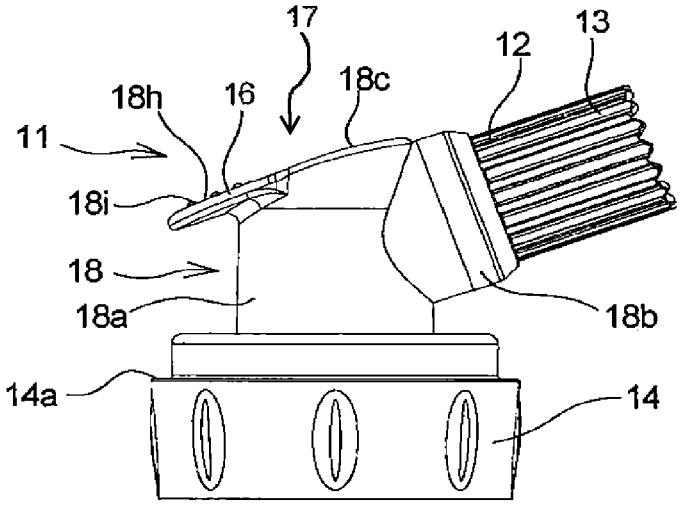
Figure 4C:
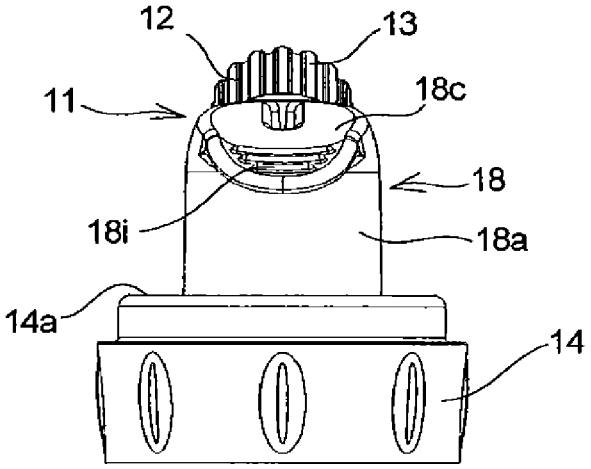
Figure 4D:
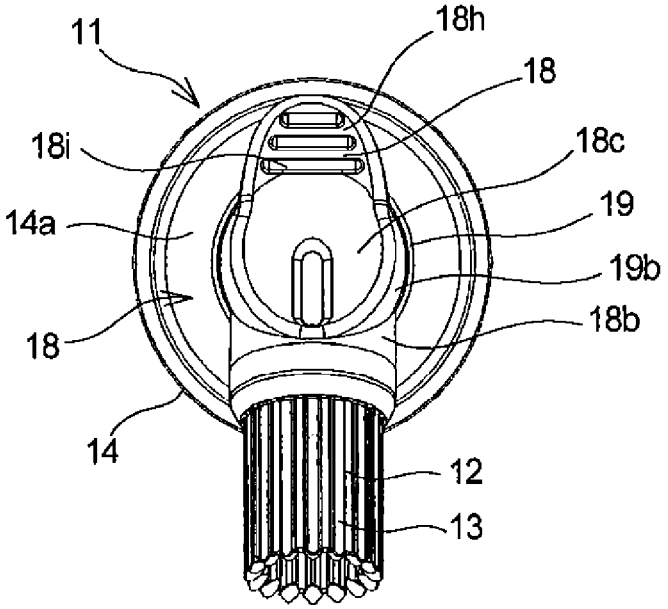
Figure 4E:
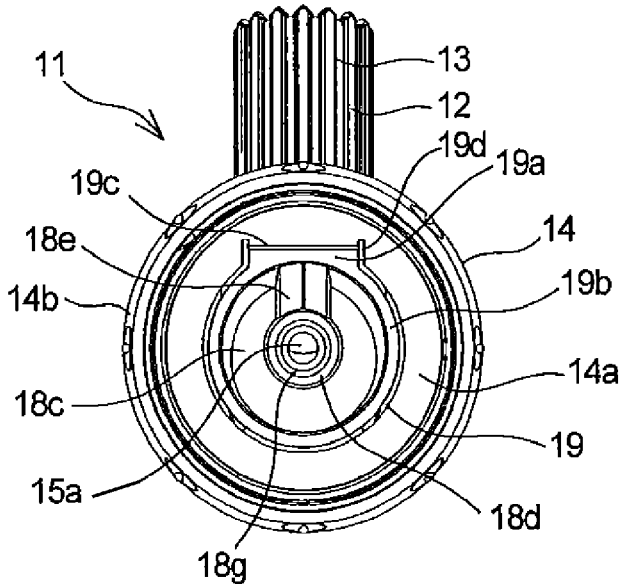

As illustrated in FIGS. 1 to 3, the applicator-equipped aerosol container 10 of the present embodiment is an aerosol container including: an aerosol main body 20 in which a hair treating agent and a propellant are contained; and an applicator 11 that includes a comb-teeth part 12 and that is attached to an upper end section of the aerosol main body 20 via a cap part 14. The applicator 11 includes: an application flow path 15 having one end 15*a* thereof in communication with a stem part 21 of the aerosol main body 20, and the other end 15*b* thereof opened into the comb-teeth part 12; and a stem press-down mechanism 17 including a finger-placing part 16 for downwardly pressing the stem part 21.

Comb teeth 13 of the comb-teeth part 12 are provided so as to extend out from a comb-teeth base part 12*a*, and the direction toward which the comb teeth 13 extend is in one direction which is outward from the cap part 14 and which is inclined with respect to the axial direction X of the stem part 21. The linger-placing part 16 is arranged above an imaginary extension line Y' (an extension line of the center axis of the lowermost, comb tooth 13) that is in a direction opposite from the direction Y toward which the lowermost comb tooth 13, among the plurality of comb teeth 13, extends.

Further, in the present embodiment, the comb-teeth part 12 and the finger-placing part 16 are provided in a head part 18 that protrudes upward from a top surface 14*a* of the cap part 14. The stem press-down mechanism 17 is formed by arranging the head part 18 in a downwardly-pressable cantilever region 19*b* that is provided in a cantilevered fashion from a cantilever base-end part 19*a* which is contiguous to the top surface 14*a*. In the present embodiment, the cantilever base-end part 19*a* is provided on a side, of the cantilever region 19*b*, in the direction toward which the comb teeth 13 extend. By receiving a press-down force from the finger-placing part 16, the head part 18 is pressed downward by employing the cantilever base-end part 19*a* as a support, and thereby, the head part 18 downwardly presses the stem part 21 which is in communication with the one end 15*a* of the application flow path 15, and causes the hair treating agent to be ejected from the aerosol main body 20 to the comb-teeth part 12 via the application flow path 15.

Further, in the present embodiment, the cantilever region 19*b* is provided as a region, in the top surface 14 of the cap part 14, in which the cantilever base-end part 19*a* is left intact by forming a penetration section 19 in the top surface 14*a*, and preferably by forming a penetration section 19 that surrounds at least three sides of the region while leaving the cantilever base-end part 19*a* intact. The penetration section 19 is preferably provided in the form of a line or a slit.

In the present embodiment, the aerosol main body 20 of the applicator-equipped aerosol container 10 has the same structure as a known aerosol container that is capable of causing contents (hair treating agent) sealed inside a container main body 22 together with a propellant to be jetted by downwardly pressing a stem part 21 that protrudes from an upper end section of a mounting cap 23 that seals the container main body 22. The aerosol main body 20 includes: a container main body 22 including a vertically-long cylindrical body part 22*a*; a mounting cap 23 that is joined to and integrated with the upper end section of the body part 22*a* of the container main body 22 and that seals the container main body 22; and an intermediate cap part 24 that is attached and fixed to and integrated with the upper end section of the container main body 22 so as to cover the circumference of the mounting cap 23.

The container main body 22 is preferably a cylindrical part having a bottom and made of metal. The body part 22*a* of the container main body 22 has a vertically-long cylindrical shape having an outer diameter of about 20 to 60 mm, for example. This makes it easy to perform the operation of pressing down on the finger-placing part 16 while gripping the body part 22*a*, and the operation of combing the hair while gripping the body part 22*a*. The mounting cap 23 is joined to and integrated with the upper end section of the container main body 22 by employing a firm joining means known in the art, such as crimping, so as to cover the upper end opening in the container main body 22. In this way, a hair treating agent, such as a hair dye agent, is sealed inside the container main body 22 together with a propellant.

The mounting cap 23 is a known member made of metal and having therein a valve-embedded part. The stem part 21 protrudes from the upper end section of the mounting cap 23 in a state where the stem part is biased by a spring in the valve-embedded part. By downwardly pressing the stem part 21 against the biasing force from the valve-embedded part, the valve can be opened and a hair treating agent, such as a hair dye agent, can be jetted out from the stem part 21.

The intermediate cap part 24 is preferably an injection-molded product made of a synthetic resin. The intermediate cap part 24 is employed as an intermediate component that allows the applicator 11 (described later) to be detachably attached easily to the upper end section of the aerosol main body 20 in a state where the application flow path 15 is in communication with the stem part 21. The intermediate cap part 24 has a substantially cylindrical shape having a two-stage structure including a lower wide-diameter part 24*a* and an upper male screw part 24*b*. The lower wide-diameter part 24*a* has an inner diameter similar to the outer diameter of the body part 22*a* of the container main body 22. The upper male screw part 24*b* has an inner diameter similar to the outer diameter of the mounting cap 23. A male screw thread is provided on the outer circumferential surface of the upper male screw part 24*b*. A plurality of upper-end retaining ribs 24*c* that protrude radially inward from the inner surface of the upper end section of the upper male screw part 24*b* are provided at a plurality of positions with intervals therebetween in the circumferential direction.

The intermediate cap part 24 is pressed-in from above the mounting cap 23 so as to be filled toward the upper end section of the container main body 22 and the mounting cap 23 until the inner step part between the lower wide-diameter part 24*a* and the upper male screw part 24*b* abuts against the shoulder part between the body part 22*a* of the container main body 22 and the mounting cap 23. In this way, the intermediate cap part 24 is attached in a state where it is joined to and integrated with the upper end section of the container main body 22 and the mounting cap 23 so as to cover the same. Also, the upper-end retaining ribs 24*c*, which are provided so as to protrude inwardly from the upper end section of the upper male screw part 24*b*, abut against the upper end surface of the circumferential edge section of the mounting cap 13. By fastening a female screw skirt part 14*b* of the cap part 14 of the applicator 11 onto the upper male screw part 24*b* of the intermediate cap part 24 that has been attached, the applicator 11 is detachably and replaceably attached to and integrated with the upper end section of the aerosol main body 20 in a state where the application flow path 15 is in communication with the stem part 21.

In the present embodiment the applicator 11 of the applicator-equipped aerosol container 10 is preferably an injection-molded product made of a synthetic resin. As illustrated in FIGS. 2, 3, and 4(*a*) to 4(*e*), the applicator 11 includes a comb-teeth part 12, a cap part 14, and a head part 18. Further, in the present embodiment, the cap part 14 and the head part 18 are formed as an integrated molded product, whereas the comb-teeth part 12 is formed as a molded product separate therefrom. After being molded, the comb-teeth part 12 is fixed to and integrated with a comb-teeth attachment part 18*b* at the front end of the head part 18.

The cap part 14 of the applicator 11 includes: a top surface 14*a* that has a circular, substantially flat-plate shape; and a female screw skirt part 14*b* that is provided so as to be extended downward from the outer circumferential edge of the top surface 14*a*, and that has a substantially cylindrical shape. A stepped shoulder part 14*c* is formed in a corner section where the top surface 14*a* and the female screw skirt part 14*b* contact one another. A female screw thread (cf. FIG. 3) is provided in the inner circumferential surface of the female screw skirt part 14*b*. By screwing the female screw thread onto the male screw thread provided on the outer circumferential surface of the upper male screw part 24*b* of the intermediate cap part 24, the female screw skirt part 14*b* is fastened to the upper male screw part 24*b*, and the applicator 11 can be attached to and integrated with the upper end section of the aerosol main body 20 in a state where the application flow path 15 is in communication with the stem part 21.

In the present embodiment, in the top surface 14*a* of the cap part 14, a penetration section 19 that penetrates the top surface 14*a* from top to bottom is formed by being cut so as to extend along e.g. the circumferential direction while leaving the cantilever base-end part 19*a* intact. The penetration section 19 is preferably a slit-form penetration line that is curved in an arc shape, and a cantilever region 19*b* is provided in such a manner that at least three sides of the cantilever region 19*b* are surrounded by the penetration line 19 (cf. FIG. 4(*e*)). By receiving a pressing force from above, the cantilever region 19*b* rotates downward about the cantilever base-end part 19*a* by employing the cantilever base-end part 19*a* as a support, and is pressed downward so as to cave in (cf. FIG. 3). Further, a bending guide section 19*c* consisting, for example, of a thin-walled line is provided in the cantilever base-end part 19*a*. In this way, the cantilever region 19*b* can be pressed downward more smoothly. Preferably, the bending guide section 19*b* is provided at the cantilever base-end part 19*a* of the top surface 14*a* or in a section near the cantilever base-end part 19*a*. Further, preferably, the bending guide section 19*b* is provided by forming a groove in the back surface or the front surface of the top surface 14*a*. The head part 18, which includes the comb-teeth part 12, the application flow path 15, and the finger-placing part 16, is provided within the cantilever region 19*b*, which is surrounded by the penetration line 19, so as to stand up in a state where the head part 18 protrudes upward from the top surface 14*a* (cf. FIG. 2). Further, in the top surface 14*a* of the cap part 14, a boundary section between the penetration section 19 and the cantilever base-end part 19*a* is provided with extended penetration sections 19*d* that extend from the respective ends of the penetration section 19 toward the outside of the top surface 14*a*.

In the present embodiment, the head part 18 includes: a head main body 18*a* having a top surface and having a substantially cylindrical shape with an outer diameter that gradually decreases from the substantially-circular lower end section formed along the penetration line (penetration section) 19 toward the upper end section; a comb-teeth attachment part 18*b* formed obliquely upward from the head main body 18*a*; and a finger-placing part 16 provided on the opposite side from the comb-teeth attachment part 18*b* across the head main body 18*a*. In the present embodiment, the finger-placing part 16 is formed by a projecting lever part 18*h* that is provided so as to project obliquely downward from the head main body 18*a*. The top surface 18*c* of the head main body 18*a* is formed so as to be obliquely inclined along the direction in which the projecting lever part 18*h* projects obliquely downward, and along the direction in which the comb-teeth attachment part 18*b* extends obliquely upward.

In the present embodiment as illustrated in FIG. 3, an application flow path 15 is formed in the hollow interior of the head main body 18*a*. The application flow path 15 is provided such that: one end 15*a* is opened in a lower end section of a stem joining part 18*d* that is supported by the top surface 18*c* and that is arranged in the lower central section of the head main body 18*a*; the application flow path passes through the central section of the stem joining part 18*d* and then passes through a bent pipe section 18*e* that is provided so as to bend toward the central section of the comb-teeth attachment part 18*b*; and the other end 15*b* is opened in the central section of the comb-teeth attachment part 18*b*. Preferably, the application flow path 15 is formed as a flow path having the same inner diameter of, for example, from around 1.5 to 4.0 mm from the one end 15*a*, which is opened in the lower end section of the stem joining part 18*d*, up to the other end 15*b*, which is opened in the front end of the bent pipe section 18*e*. A joining recess 18*g* that has a slightly greater inner diameter than the outer diameter of the stem part 21 and into which the upper end section of the stem part 21 is fitted and attached is provided in the lower end section of the stem joining part 18*d* so as to have a greater diameter than the application flow path 15.

The front end section of the bent pipe section 18*e* is arranged so as to slightly protrude frontward than the attachment joining surface formed by the comb-teeth attachment part 18*b*. In this way, at the time of attaching and integrating the comb-teeth part 12 to the comb-teeth attachment part 18*b* via an annular engagement rib 18*f*, the front, end section of the bent pipe section 18*e* is brought, into engagement by being fitted into an ejection opening 12*b*, which is formed by penetrating the central section of the comb-teeth base part 12*a* of the comb-teeth part 12, and thus, the other end 15*b* of the application flow path 15 can be opened as an ejection opening in the central section of the comb-teeth base part 12*a*.

As described above, the comb-teeth part 12 is molded separately from the cap part 14 and the head part 18, and includes: a comb-teeth base part 12*a*; and a plurality of comb teeth 13 provided so as to stand up from the comb-teeth base part 12*a*. Preferably, the comb-teeth base part 12*a* is arranged outward of the outer circumferential surface of the head main body 18*a*. The comb-teeth base part 12*a* is a substantially disk-shaped section having an outer diameter that is substantially the same as that of the comb-teeth attachment part 18*b* of the head part 18. The aforementioned ejection opening 12*b* is formed and penetrated in the central section of the comb-teeth base part 12*a*. An annular engagement groove 12*c* is formed so as to protrude toward the rear side from the circumferential edge section of the comb-teeth base part 12*a*. By engaging the annular engagement rib 18*f* of the comb-teeth attachment part 18*b* of the head part 18 into the annular engagement groove 12*c*, the comb-teeth part 12 is joined to and integrated with the head part 18 in a state where the front end section of the bent pipe section 18*e* is engaged with the ejection opening 12*b*. In this way, the comb teeth 13 of the comb-teeth part 12 are arranged so as to extend outward on one side from the comb-teeth base part 12*a* and obliquely upward by an angle θ with respect to an imaginary plane P perpendicular to the axial direction X of the stem part 21 along the direction in which the comb-teeth attachment part 18*b* extends obliquely upward. Stated differently, the direction toward which the comb teeth 13 extend is in an obliquely upward direction with respect to an imaginary plane P that is perpendicular to the axial direction X of the stem part 21.

The angle θ of the extension direction in which the comb teeth 13 of the comb-teeth part 12 extend sideways or obliquely upward with respect to an imaginary plane P perpendicular to the axial direction X of the stem part 21 is, for example, from 5 to 50°, preferably from 10 to 40°, even more preferably from 15 to 25°. Making the comb teeth 13 of the comb-teeth part 12 extend outward on one side at this angle θ allows the user to easily see the position of the comb teeth 13 at the time of application, and allows accurate application. Also, application is possible from various angles without placing any load on the wrist.

In the present embodiment, the plurality of comb teeth 13 of the comb-teeth part 12 are preferably aligned annularly—such as in a circular shape, an elliptical shape, or an annular polygonal shape (an annular polygonal shape such as an equilateral triangle, equilateral hexagon, or equilateral octagon)—so as to surround the periphery of the ejection opening 12*b* in the comb-teeth base part 12*a*'s central section, which is where the other end 15*b* of the application flow path 15 opens. More preferably, the plurality of comb teeth 13 of the comb-teeth part 12 are aligned circularly so as to surround the periphery of the ejection opening 12*b*, which is where the other end 15*b* of the application flow path 15 opens. In the present embodiment, the plurality of comb teeth 13 of the comb-teeth part 12 include: main comb teeth 13*a* that are aligned circularly along the circumferential edge section of the comb-teeth base part 12*a*; and auxiliary comb teeth 13*b* that are aligned circularly and concentrically on the inner side of the main comb teeth 13*a*. Each main comb tooth 13*a* is provided so as to stand up from the comb-teeth base part 12*a* with a length of, for example, from around 10 to 20 mm, and has a thickness of, for example, from around 1.5 to 2.5 mm. Each auxiliary comb tooth 13*b* is provided so as to stand up from the comb-teeth base part 12*a* with a length of, for example, from around 5 to 10 mm, and has a thickness of, for example, from around 0.5 to 1.2 mm.

By aligning the plurality of comb teeth 13 of the comb-teeth part 12 annularly so as to surround the periphery of the ejection opening 12*b*, which is where the other end 15*b* of the application flow path 15 opens, it is possible to capture a bundle of hair with the comb teeth 13 and appropriately apply a hair cosmetic only to that bundle. By aligning the plurality of comb teeth 13 of the comb-teeth part 12 circularly so as to surround the periphery of the ejection opening 12*b*, it is possible to apply a hair cosmetic to the hair at a uniform width from various angles. By including, in the plurality of comb teeth 13 of the comb-teeth part 12, circularly-aligned main comb teeth 13*a* and auxiliary comb teeth 13*b* aligned circularly and concentrically on the inner side of the main comb teeth, it is possible to uniformly apply a hair cosmetic to the entire bundle of hair captured with the main comb teeth 13*a*.

In the present embodiment, as illustrated in FIGS. 2 and 3, the finger-placing part 16 is preferably formed by a projecting lever part 18*h* that is provided so as to project from the upper end section of the head main body 18*a* of the applicator 11 toward the opposite side from the comb-teeth attachment part 18*b* across the head main body 18*a*, which is toward the opposite side from the direction toward which the comb teeth 13 of the comb-teeth part 12 extend. The projecting lever part 18*h* is provided so as to project obliquely downward on a side opposite from the direction toward which the comb teeth 13 extend and along the obliquely-upward direction in which the comb teeth 13 of the comb-teeth part 12 extend. Stated differently, the direction toward which the projecting lever part 18*h* projects is in an obliquely downward direction with respect to an imaginary plane P that is perpendicular to the axial direction X of the stem part 21. The projecting lever part 18*h*, which is the finger-placing part 16, is provided so as to project obliquely downward from the head main body 18*a*'s top surface 18*c*—which is formed so as to be obliquely inclined along the direction in which the comb-teeth attachment part 18*b* extends obliquely upward, which is the direction in which the comb teeth 13 of the comb-teeth part 12 extend—along the obliquely-inclined direction of the top surface 18*c* and on the opposite side from the comb-teeth attachment part 18*b*. The projecting lever part 18*h* is formed as a part having a planar, substantially semi-elliptical shape. The projecting lever part 18*h* is provided with a size that fits within a region immediately above the cap part 14, without projecting radially outward from the female screw skirt part 14*b* of the cap part 14. A plurality of anti-slip linear protrusions 18*i* are formed with intervals therebetween on the upper surface of the projecting lever part 18*h*.

Further, in the present embodiment, the finger-placing part 16, which is constituted by the projecting lever part 18*h*, is arranged above an imaginary center-axis extension line Y' in a direction opposite from the extension direction Y of the lowermost comb tooth 13 extending from the comb-teeth base part 12*a*. The finger-placing central section of the finger-placing part 16 can be provided so as to be arranged in a position that is, for example, from 8 to 20 mm separated from the imaginary extension line Y' of the central axis of the lowermost comb tooth 13 extending from the comb-teeth base part 12*a*. Further, it is preferable to arrange the finger-placing central section of the finger-placing part 16 in a position that is preferably from 10 to 17 mm, more preferably in a position that is from 12 to 15 mm, separated from the imaginary extension line Y' of the central axis of the lowermost comb tooth 13. Moreover, the imaginary center-axis extension line in a direction opposite from the extension direction of the lowermost comb tooth 13 extending from the comb-teeth base part 12*a* is preferably arranged below the finger-placing central section of the finger-placing part 16. By arranging the finger-placing part 16 in this position, operation can be simplified, and a hair cosmetic can be applied accurately to the targeted position.

Moreover, in the present embodiment, the penetration line 19—which is formed so as to surround at least three sides of the cantilever region 19*b* from which the head main body 18*a* of the head part 18 stands up—is formed in a substantially circular shape along the shape of the lower end section of the head main body 18*a* in a manner such that the cantilever base-end part 19*a* where the penetration line 19 is not formed is arranged on a side, of the cantilever region 19*b*, in the direction toward which the comb teeth 13 of the comb-teeth part 12 extend. Stated differently, the cantilever base-end part 19*a* is provided on a side, of the cantilever region 19*b*, in the direction toward which the comb teeth 13 of the comb-teeth part 12 extend obliquely upward.

By providing the cantilever base-end part 19*a* on the side in the direction toward which the comb teeth 13 of the comb-teeth part 12 extend, the cantilever region 19*b* can be pressed-in downward while rotating by being supported by the cantilever base-end part 19*a*, which is located on the side of the comb teeth 13's extending direction, such that the comb teeth 13's extending direction is directed further upward when the stem part 21 is pressed downward by means of the head part 18 by applying a pressing force to the finger-placing part 16, which preferably projects toward the opposite side from the direction toward which the comb teeth 13 extend. Thus, at the time of performing the operation of applying a hair treating agent, such as a hair dye agent, to hair in a predetermined region by pressing the comb teeth 13 of the comb-teeth part 12 against the scalp, the container is easier to hold in a state where the hand gripping the body part 22*a* of the container main body 22 is separated from the scalp, and the application operation can be performed more smoothly. Further, by applying a pressing force to the finger-placing part 16, which preferably projects toward the opposite side from the direction toward which the comb teeth 13 extend, the comb teeth 13's extending direction is directed further upward; thus, the comb teeth 13 move toward the visual-field side in conjunction with the movement of the finger, thus enabling accurate application of a hair cosmetic to hair in a predetermined region while combing the hair at the same time as checking the process with the eyes more easily. Directing the comb teeth 13's extending direction more upward also allows the hair cosmetic to be applied to the hair while combing the hair without soiling the top surface 14*a* of the cap part 14.

It should be noted that, in the present embodiment, the stem press-down mechanism 17 that is for downwardly pressing the stem part 21 and that is provided with the finger-placing part 16 is constituted by: the head part 18 provided so as to stand up from the cantilever region 19*b* in the top surface 14*a* of the cap part 14; the penetration line (penetration section) 9 formed in the top surface 14*a* of the cap part 14 so as to surround at least three sides of the lower end section of the head part 18; the cantilever base-end part 19*a* where the penetration line 19 is not formed; and the finger-placing part 16 constituted by the projecting lever part 18*h* provided so as to project from the upper end section of the head part 18.

With the applicator-equipped aerosol container 10 of the present embodiment having the aforementioned structure, a user grips the body part 22*a* of the aerosol main body 20 with e.g. four fingers except for the index finger, and places the index finger on the finger-placing part 16 constituted by the projecting lever part 18*h*, and in this state, presses the comb teeth 13 of the comb-teeth part 12 against hair in a predetermined region to be dyed, for example. Then, by applying a pressing force to the finger-placing part 16, the head part 18 is pressed-in downward by employing the cantilever base-end part 19*a* as a support, and the stem part 21 is pressed downward by means of the head part 18, and thereby, a hair treating agent, such as a hair dye agent is ejected. Because the finger-placing part 16 projects outward toward the opposite direction from the cantilever base-end part 19*a*, the stem part 21 can be pressed downward by applying a weaker force to the finger-placing part 16. By sliding and moving the aerosol main body 20 and the comb teeth 13 in a predetermined direction with the hand, which is gripping the body part 22*a*, at the same time as downwardly pressing the stem part 21 and ejecting the hair treating agent such as the hair dye agent, it is possible to apply the hair treating agent to the hair while combing the hair.

Further, with the applicator-equipped aerosol container 10 of the present embodiment, it is possible to stably and efficiently perform the operation of applying a hair treating agent, such as a hair dye agent, while combing the hair at the same time as ejecting the hair treating agent accurately and precisely to hair in a predetermined region.

More specifically, according to the present embodiment, the applicator 11 includes: an application flow path 15 having one end 15*a* thereof in communication with a stem part 21 of the aerosol main body 20, and the other end 15*b* thereof opened into the comb-teeth part 12; and a stem press-down mechanism 17 including a finger-placing part 16 for downwardly pressing the stem part 21. The comb teeth 13 of the comb-teeth part 12 are provided so as to extend out from a comb-teeth base part 12*a*, and the direction toward which the comb teeth 13 extend is in one direction which is outward from the cap part 14 and which is inclined with respect to the axial direction X of the stem part 21. The finger-placing part 16 is arranged above an imaginary extension line Y' that is in a direction opposite from the direction Y toward which the lowermost comb tooth 13, among the plurality of comb teeth 13, extends.

Thus, according to the applicator-equipped aerosol container 10 of the present embodiment, in a state where the body part 22*a* of the aerosol main body 20 is gripped and, for example, the index finger is placed on the finger-placing part 16, at least a portion of the comb teeth 13 of the comb-teeth part 12 can be arranged between the hand gripping the body part 22*a* of the aerosol main body 20 and the finger placed on the finger-placing part 16. More specifically, in the present embodiment, as described above, an imaginary center-axis extension line in a direction opposite from the extension direction of the uppermost comb tooth 13 extending from the comb-teeth base part 12*a* is preferably arranged below the finger-placing central section of the finger-placing part 16. Thus, in a stale where, for example, the index finger is placed on the finger-placing part 16, all of the comb teeth 13—as the aforementioned at least a portion of the comb teeth 13—can be arranged between the hand gripping the body part 22*a* of the aerosol main body 20 and the finger placed on the finger-placing part 16. Further, the finger-placing central section of the finger-placing part 16 can be provided so as to be arranged: above an imaginary extension line Y' in a direction opposite from the direction Y toward which the lowermost comb tooth 13, among the plurality of comb teeth 13, extends; and at a discretionary position between this imaginary extension line Y' and an imaginary center-axis extension line in a direction opposite from the direction toward which the uppermost comb tooth 13 extends. Thus, in a state where, for example, the index finger is placed on the finger-placing part 16, at least a portion of the comb teeth 13 of the comb-teeth part 12 can be arranged between the hand gripping the body part 22*a* of the aerosol main body 20 and the finger placed on the finger-placing part 16. Further, to make it possible to arrange at least a portion of the comb teeth 13 of the comb-teeth part 12 between the hand gripping the body part 22*a* of the aerosol main body 20 and the finger placed on the finger-placing part 16 in a state where, for example, the index finger is placed on the finger-placing part 16, it is preferable to provide the finger-placing central section of the finger-placing part 16 in a position that, is preferably from 8 to 20 mm, more preferably in a position that is from 10 to 17 mm, and even more preferably in a position that is from 12 to 15 mm, separated from the imaginary extension line Y' of the central axis of the lowermost comb tooth 13 extending from the comb-teeth base part 12*a*.

Herein, the finger-placing central section of the finger-placing part 16 is a central section on the upper surface of the finger-placing part 16, which is where it is considered the easiest to apply a pressing force at the time of applying a pressing force to downwardly press the stem part 21 by placing a finger on the finger-placing part 16 and pressing-in the head part 18 downward.

A hair treating agent, such as a hair dye agent, is ejected by applying a pressing force to the finger-placing part 16 while pressing the comb teeth 13 of the comb-teeth part 12 against hair in a predetermined region in a state where the index finger is placed on the finger-placing part 16 and at least a portion of the comb teeth 13 of the comb-teeth part 12 is arranged between the hand gripping the body part 22*a* of the aerosol main body 20 and the finger placed on the finger-placing part 16. Simultaneously, the aerosol main body 20 and the comb teeth 13 are made to slide and move in a predetermined direction. Thereby, it is possible to apply a hair treating agent to the hair while combing the hair. At this time, the applicator 11 can be supported at two points—i.e., with the gripped body part 22*a* of the aerosol main body 20 and the finger-placing part 16 to which the pressing force is applied—which are arranged so as to sandwich at least a portion of the comb teeth 13. Thus, at the time of performing the operation of applying a hair treating agent by pressing the comb teeth 13 against the hair, the moment force applied to the comb-teeth part 12 can be effectively supported at two points, and thus, it is possible to stably and efficiently perform the operation of applying a hair treating agent, such as a hair dye agent, while combing the hair at the same time as ejecting the hair treating agent accurately and precisely to hair in a predetermined region.

Further, the applicator-equipped aerosol container 10 of the present embodiment does not have a long-narrow neck part interposed between the finger-placing part and the comb-teeth part as in conventional applicator-equipped aerosol containers having a comb-teeth part, but instead, the finger-placing part 16 is arranged above an imaginary center-axis extension line Y' in a direction opposite from the direction Y toward which the lowermost comb tooth 13 of the comb-teeth part 12 extends, and is provided so as to project toward the opposite side from the comb-teeth part 12 across the head main body 18*a*. Thus, the finger-placing part 16 and the comb-teeth part 12 are arranged closer to one another. In this way, the operation of applying a hair treating agent, such as a hair dye agent, to hair in a predetermined region while combing the hair at the same time as ejecting the hair treating agent accurately and precisely can be performed more stably and efficiently.

Furthermore, according to the present embodiment, the finger-placing part 16, which is constituted by the projecting lever part 18*h*, is provided so as to project along the direction in which the comb teeth 13 of the comb-teeth part 12 extend obliquely upward and on a side opposite from the direction toward which the comb teeth 13 extend. Thus, a distance can be provided between the finger-placing part 16 and the comb teeth 13, and thus, the finger can be effectively prevented from getting soiled at the time of application.

Moreover, according to the present embodiment, the application flow path 15 is a flow path having the same inner diameter from the one end 15*a* which is in communication with the stem part 21 up to the other end 15*b* that opens into the comb-teeth base part 12*c* of the comb-teeth part 12, without being provided with e.g. a liquid reservoir before the comb-teeth base part 12*c*. Thus, even if a considerable time passes before the once-used applicator-equipped aerosol container 10 is used the next time, the application flow path 15 can be effectively prevented from getting clogged, and also, the applicator 11 can be cleaned easily.

Figure 5:
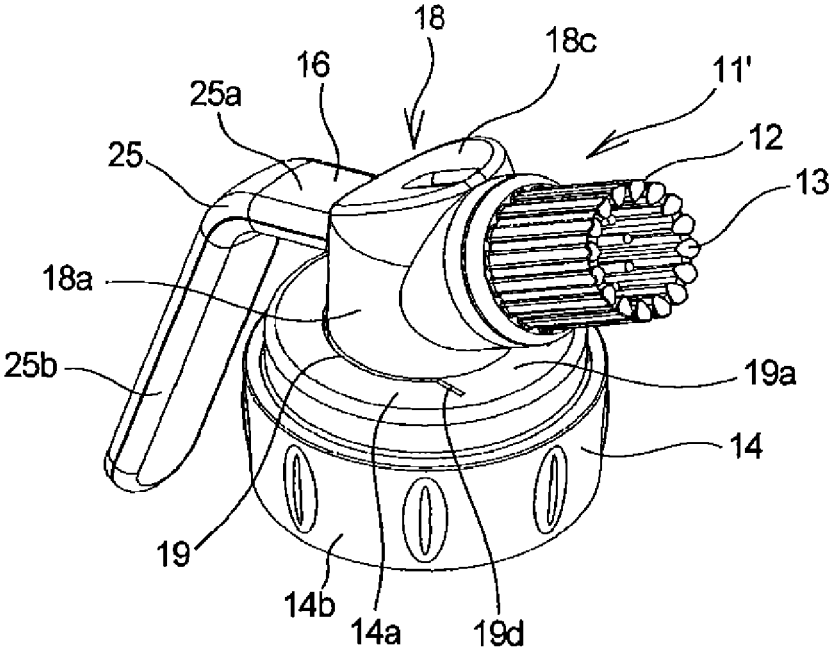
FIG. 5 is a perspective view of an applicator of another embodiment.

FIG. 5 is an example of another embodiment of an applicator 11' constituting an applicator-equipped aerosol container 10 together with an aerosol main body 20. As illustrated also in FIGS. 6(*a*) to 6(*e*), the applicator 11' illustrated in FIG. 5 has a similar structure to the applicator 11 of the foregoing embodiment illustrated in FIG. 2, except that the structure of the finger-placing part 16 is different. It should be noted that, in the applicator 11' of this other embodiment illustrated in FIG. 5, features that are the same as those in the applicator 11 of the foregoing embodiment are accompanied by the same reference signs, and detailed explanation thereof is omitted as appropriate. The explanation on the applicator 11 of the foregoing embodiment applies as appropriate to features accompanied by the same reference signs as in the applicator 11 of the foregoing embodiment.

In the applicator 11' of this other embodiment illustrated in FIG. 5, the finger-placing part 16 is formed by a handle-shaped lever part 25 that is provided so as to project from the upper end section of the head main body 18*a* of the applicator 117 toward the opposite side from the comb-teeth attachment part 18*b* across the head main body 18*a*, which is toward the opposite side from the direction toward which the comb teeth 13 of the comb-teeth part 12 extend. The handle-shaped lever part 25 includes: a base lever part 25*a* provided so as to project obliquely downward from a position that is a notch lower than the head main body 18*a*'s top surface 18*c* and substantially along the obliquely-inclined direction of the top surface 18*c* and on the opposite side from comb teeth 13; and a handle part 25*b* that is bent obliquely downward from the base lever part 25*a* and is further extended therefrom. The base lever part 25*a* of the handle-shaped lever part 25 forms the finger-placing part 16 for downwardly pressing the stem part 21 by means of the head part 18 by applying a pressing force.

Figure 6C:
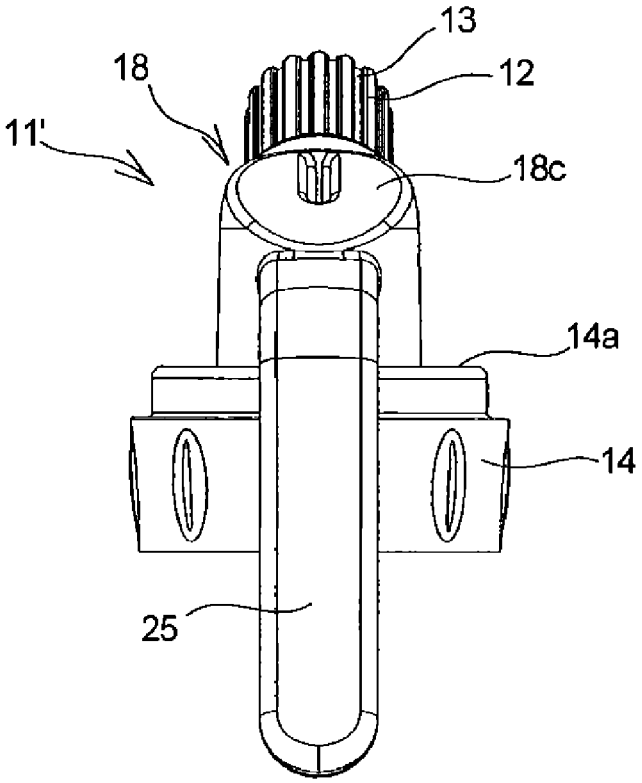
FIG. 6(*a*) is a front view of an applicator of another embodiment.
Figure 6D:
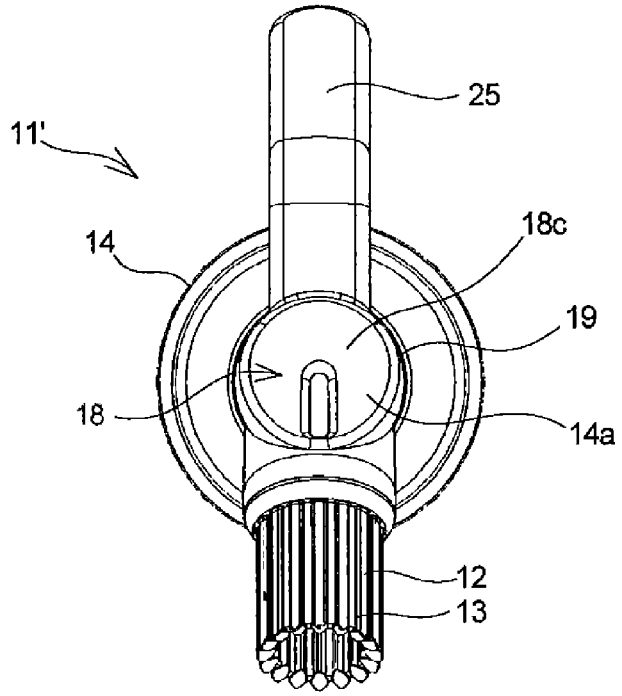
Figure 6E:
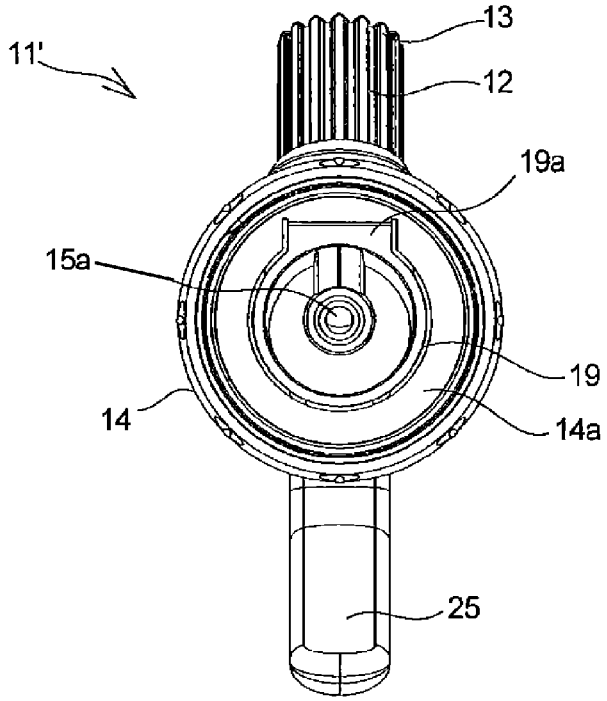

Also in this applicator-equipped aerosol container 10 provided with the applicator 11' of this other embodiment illustrated in FIG. 5, the finger-placing part 16, which is constituted by the base lever part 25*a* of the handle-shaped lever part 25, is arranged above an imaginary extension line Y' that is in a direction opposite from the direction Y toward which the lowermost comb tooth 13, among the plurality of comb teeth 13, extends (cf. FIG. 6(*b*)). This facilitates the operation of applying a hair treating agent, such as a hair dye agent, while combing the hair at the same time as ejecting the hair treating agent, thus achieving the same effects as the applicator-equipped aerosol container 10 having the applicator 11 illustrated in FIG. 2. Further, by providing the handle-shaped lever part 25 with the handle part 25*b* which is further extended from the base lever part 25*a*, the operation is further facilitated, and the hair treating agent can be ejected with smaller force.

Figure 7:
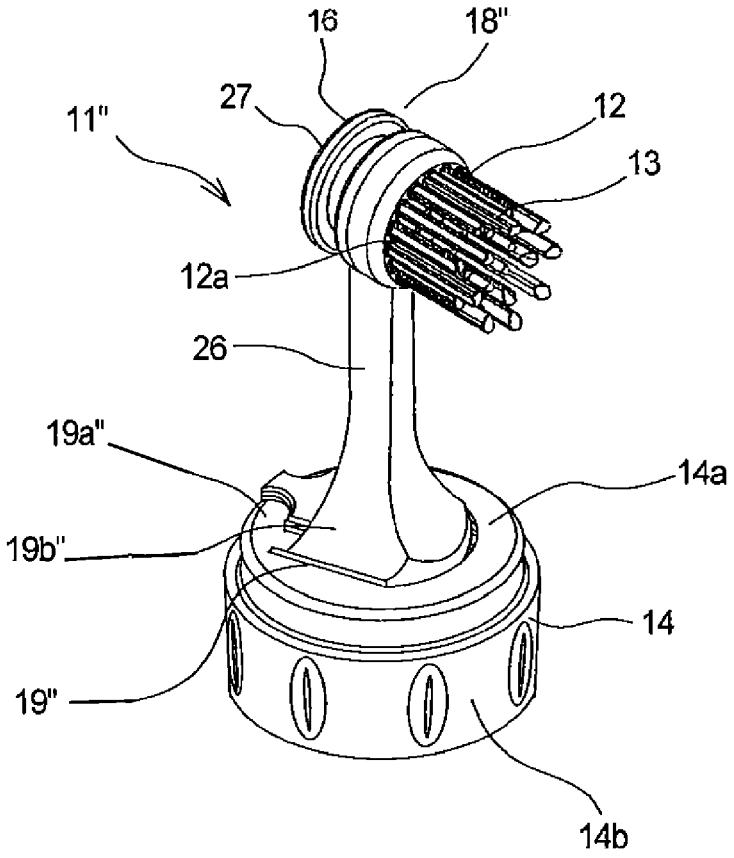
FIG. 7 is a perspective view of an applicator of yet another embodiment.
Figure 8A:
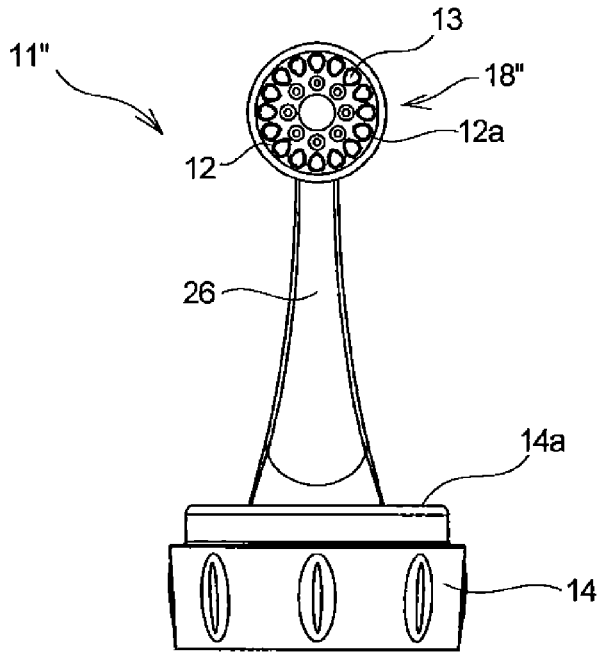
FIG. 8(*a*) is a front view of an applicator of yet another embodiment.
Figure 8B:
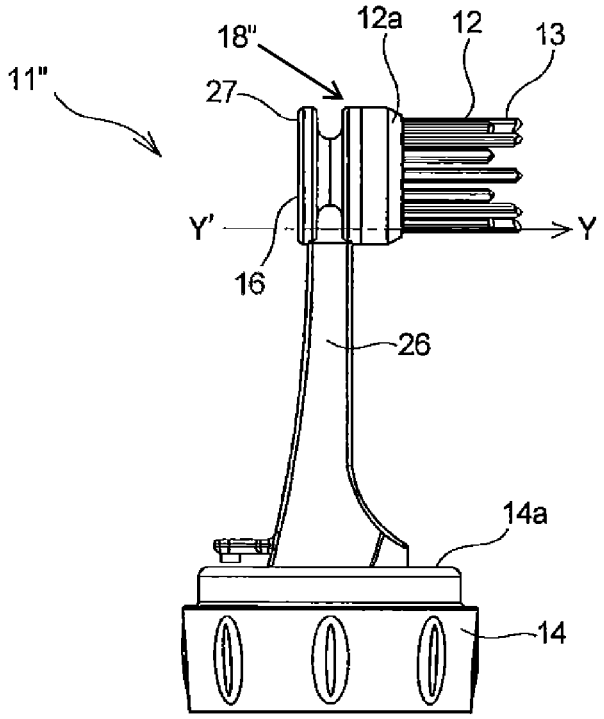
Figure 8C:
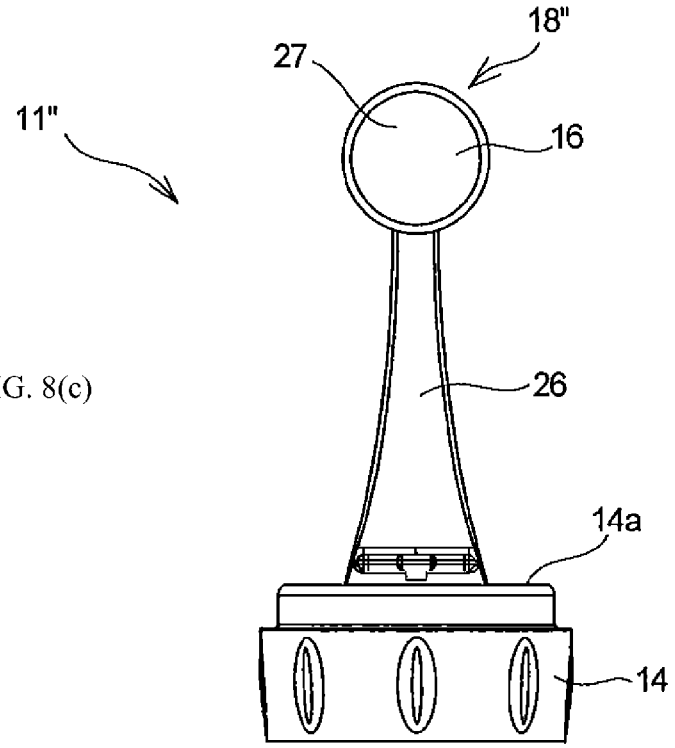
Figure 8D:
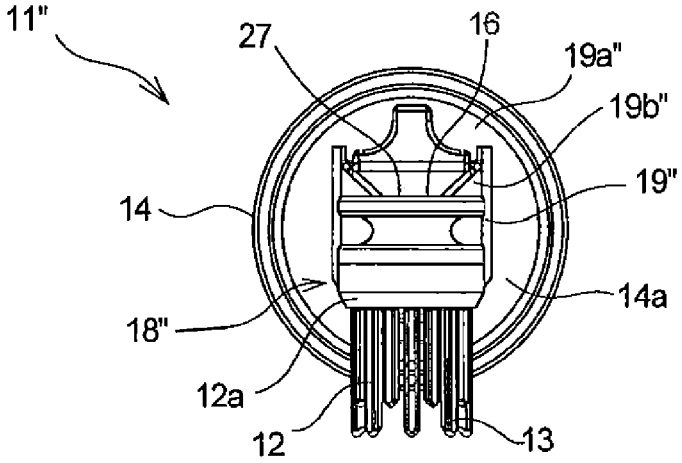
Figure 8E:
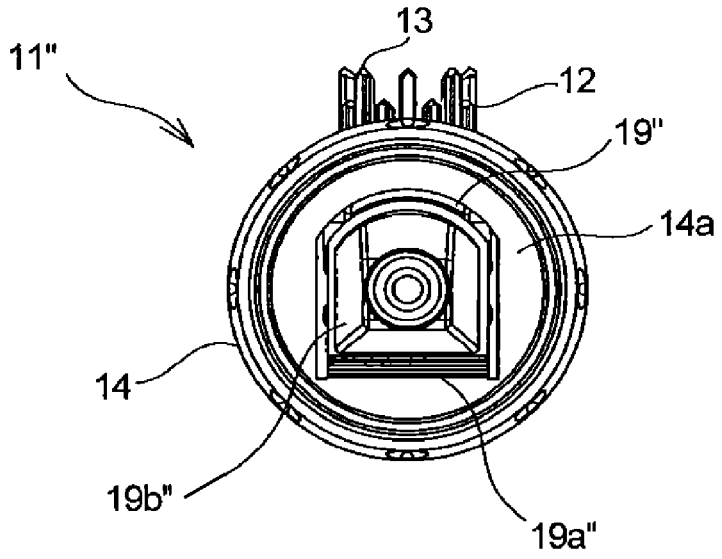

FIG. 7 is an example of yet another embodiment of an applicator 11" constituting an applicator-equipped aerosol container 10 together with an aerosol main body 20. As illustrated also in FIGS. 8(*a*) to 8(*e*), the applicator 11" illustrated in FIG. 7 has a similar structure to the applicator 11 of the foregoing embodiment illustrated in FIG. 2, except that the structures of the head part 18" having the finger-placing part 16 and the penetration line (penetration section) 19" forming the cantilever region 19*b*" are different. It should be noted that, in the applicator 11" of this further embodiment illustrated in FIG. 7, features that are the same as those in the applicator 11 of the foregoing embodiment are accompanied by the same reference signs, and detailed explanation thereof is omitted as appropriate. The explanation on the applicator 11 of the foregoing embodiment applies as appropriate to features accompanied by the same reference signs as in the applicator 11 of the foregoing embodiment.

In the applicator 11" of this further embodiment illustrated in FIG. 7, the head part 18" includes: a long-necked head base pail 26 that stands up to a considerable height from a cantilever region 19*b*" whose at least three sides are surrounded by a substantially half-track circular penetration line (penetration section) 19"; a comb-teeth part 12 that is attached to and integrated with the upper end section of the long-necked head base part 26; and a circular plate part 27 provided on the comb-teeth part 12's back surface side which is opposite from the direction toward which the comb teeth 13 extend. In the comb-teeth part 12, the comb-teeth base part 12*a* is arranged in a direction perpendicular to the top surface 14*a* of the cap part 14, and thus, the comb teeth 13 extend out sideways—as a direction inclined with respect to the axial direction X of the stem part 21—from the comb-teeth base part 12*a* along the imaginary plane P (cf. FIG. 3) perpendicular to the axial direction X. The substantially half-track circular penetration line 19" is formed such that the cantilever base-end part 19*a*" where the penetration line 19" is not formed is arranged on a side, of the cantilever region 19*b*", opposite from the direction toward which the comb teeth 13 extend, i.e., on the side where the circular plate part 27 is provided. The circular plate part 27 forms the finger-placing part 16 for downwardly pressing the stem part 21 and ejecting a hair treating agent, such as a hair dye agent. By applying a pressing force to the finger-placing part 16 constituted by the circular plate part 27, the head part 18" is rotated so as to tilt toward the direction in which the comb teeth 13 extend, and thereby, the lower end section of the long-necked head base part 26, which is arranged in the cantilever region 19*b*", can be pressed downward. Thus, a hair treating agent, such as a hair dye agent, can be ejected from the aerosol main body 20 by downwardly pressing the stem part 21.

Also in this applicator-equipped aerosol container 10 provided with the applicator 11" of this further embodiment illustrated in FIG. 7, the finger-placing part 16, which is constituted by the circular plate part 27, is arranged above an imaginary extension line Y' that is in a direction opposite from the direction Y toward which the lowermost comb tooth 13, among the plurality of comb teeth 13, extends (cf. FIG. 8(*b*)). This facilitates the operation of applying a hair treating agent, such as a hair dye agent, while combing the hair at the same time as ejecting the hair treating agent, thus achieving the same effects as the applicator-equipped aerosol container 10 having the applicator 11 illustrated in FIG. 2.

It should be noted that the present invention is not limited to the foregoing embodiments, and various modifications can be made. For example, the application flow path for feeding the hair treating agent, from the stem part to the comb-teeth part does not necessarily need to have the same inner diameter from the one end in communication with the stem part up to the other end opened into the comb-teeth part, and instead, a liquid reservoir may be provided before the comb-teeth part. Further, the hair treating agent to be ejected from the aerosol main body and applied to the hair may be a hair dye agent, or any of various other types of treatment agents known in the art as treatment agents for hair, with examples including: hair cosmetics such as bleaches; scalp lotions; oils; hair tonics; hair restorers; and anti-dandruff agents.

INDUSTRIAL APPLICABILITY

With the applicator-equipped aerosol container of the present invention, it is possible to stably and efficiently perform the operation of applying a hair treating agent while combing the hair at the same time as ejecting the hair treating agent accurately and precisely to hair in a predetermined region.

What is claimed is:

1. An applicator-equipped aerosol container comprising:

an aerosol container having an aerosol main body and containing a hair treating agent and a propellant, the aerosol container having a stem that projects in an upwards direction from an upper end section thereof, where the upwards direction defines a first axis; and an applicator comprising:

a) a cap having an annular skirt attached to an upper end section of the aerosol main body, and an annular top wall; and b) a head comprising:

i) an annular head main body extending transversely away from the top wall of the cap, the annular head main body defining a lower portion immediately adjacent the top wall of the cap and an opposing upper portion, wherein the lower portion provides:

a base end part integral with the top wall of the cap, a cantilever region spaced apart from a portion of the top wall of the cap wherein an arcuate through slit is provided between the cantilever region and the portion of the top wall immediately adjacent the cantilever region, and opposing ends of the arcuate through slit have extended penetrating sections which extend radially outward along the top wall and away from the annular head main body;

ii) a stem joining part provided within the interior of the annular head main body, the stem joining part having a first end coupled to the stem, and an opposing second end;

iii) a bent pipe section having a first end extending from the second end of the stem joining part and a second end opposite the first end, wherein the stem joining part and the bent pipe section have a continuous hollow interior which defines an application flow path;

iv) a comb located on an upper portion of the head, wherein the comb comprises:

a base with a central opening, where the second end of the bent pipe section is disposed within the central opening; and a plurality of teeth distributed around the central opening, the plurality of teeth extend outwards from the base in an inclined direction with respect to the first axis, wherein the plurality of teeth include a lower-most tooth and a second axis extends through the lower-most tooth, wherein the second axis intersects the first axis and the angle therebetween defines the inclined direction of the plurality of teeth;

v) a finger-placing part coupled to an upper portion of the annular head main body and forming an exterior surface of the head, the finger-placing part is located opposite the comb on an upper end of the head, and extends substantially parallel to and above the second axis such that the finger-placing part is inclined with respect to the first axis;

wherein during use, the finger-placing part is depressed which causes the cantilever region to move downwardly into a hollow interior of the cap and the stem to be depressed causing the hair treating agent to be ejected from the aerosol main body, through the application flow path and expelled from the central opening.

2. The applicator-equipped aerosol container according to claim 1, wherein the application flow path is a flow path having a same inner diameter from the first end of the stem joining part which is in communication with the stem up to the second end of the bent pipe section that opens into the base.

3. The applicator-equipped aerosol container according to claim 1, wherein a bending guide section is provided at the base-end part or near the base-end part.

4. The applicator-equipped aerosol container according to claim 1, wherein the plurality of teeth extends in an obliquely upward direction with respect to an imaginary plane that is perpendicular to the first axis.

5. The applicator-equipped aerosol container according to claim 1, wherein the finger-placing part is projected in an obliquely downward direction with respect to an imaginary plane that is perpendicular to the first axis.

6. The applicator-equipped aerosol container according to claim 1, wherein the plurality of teeth are aligned annularly so as to surround a periphery of the central opening of the base.

7. The applicator-equipped aerosol container according to claim 6, wherein the plurality of teeth are aligned circularly so as to surround the periphery of the central opening of the base.

8. An applicator-equipped aerosol container comprising:

an aerosol container having an aerosol main body and containing a hair treating agent and a propellant, the aerosol container having a stem that projects in an upwards direction from an upper end section thereof, where the upwards direction defines a first axis; and an applicator comprising:

a) a cap having an annular skirt attached to an upper end section of the aerosol main body, and an annular top wall; and b) a head comprising:

i) an annular head main body extending away from the top wall of the cap, the annular head main body defining a lower portion immediately adjacent the top wall of the cap and an opposing upper portion, wherein the lower portion provides:

a base end part integral with the top wall of the cap, a cantilever region spaced apart from a portion of the top wall of the cap wherein an arcuate through slit is provided between the cantilever region and the portion of the top wall immediately adjacent the cantilever region, and opposing ends of the arcuate through slit have extended penetrating sections which extend radially outward along the top wall and away from the annular head main body;

ii) a stem joining part provided within the interior of the annular head main body, the stem joining part having a first end coupled to the stem, and an opposing second end;

iii) a bent pipe section having a first end extending from the second end of the stem joining part and a second end opposite the first end, wherein the stem joining part and the bent pipe section have a continuous hollow interior which defines an application flow path;

iv) a comb located on an upper portion of the head, wherein the comb comprises:

a base with an opening, where the second end of the bent pipe section is disposed within the opening; and a plurality of teeth extending outwards from the base in an inclined direction with respect to the first axis, wherein the plurality of teeth include a lower-most tooth and a second axis extends through the lower-most tooth, wherein the second axis intersects the first axis and the angle therebetween defines the inclined direction of the plurality of teeth;

v) a finger-placing part coupled to an upper portion of the annular head main body and forming an exterior surface of the head, the finger-placing part is located opposite the comb on an upper end of the head, and extends substantially parallel to and above the second axis such that the finger-placing part is inclined with respect to the first axis;

wherein during use, the finger-placing part is depressed which causes the cantilever region to move downwardly into a hollow interior of the cap and the stem to be depressed causing the hair treating agent to be ejected from the aerosol main body, through the application flow path and expelled from the central opening.

9. The applicator-equipped aerosol container according to claim 8, wherein the plurality of teeth extends in an obliquely upward direction with respect to an imaginary plane that is perpendicular to the first axis.

10. The applicator-equipped aerosol container according to claim 8, wherein the finger-placing part is projected in an obliquely downward direction with respect to an imaginary plane that is perpendicular to the first axis.

11. The applicator-equipped aerosol container according to claim 8, wherein the plurality of teeth are aligned annularly so as to surround a periphery of the opening of the base.

12. The applicator-equipped aerosol container according to claim 11, wherein the plurality of teeth are aligned circularly so as to surround the periphery of the opening of the base.

13. The applicator-equipped aerosol container according to claim 11, wherein the application flow path has a same inner diameter from the stem joining part which is in communication with the stem up to the second end of the bent pipe section that opens into the base.

14. The applicator-equipped aerosol container according to claim 12, wherein the applicator flow path has a same inner diameter from the stem joining part which is in communication with the stem up to the second end of the bent pipe section that opens into the base.

15. The applicator-equipped aerosol container according to claim 12, wherein a bending guide section is provided at the base end part or near the base end part.

* * * * *